US007237607B2

(12) United States Patent
Angman et al.

(10) Patent No.: US 7,237,607 B2
(45) Date of Patent: Jul. 3, 2007

(54) TUBULAR STABBING PROTECTOR AND METHOD

(75) Inventors: Per G. Angman, Calgary (CA); Gustavo Adrian Lis, Calgary (CA)

(73) Assignee: Tesco Corporation, Calgary (CA)

( * ) Notice: Subject to any disclaimer, the term of this patent is extended or adjusted under 35 U.S.C. 154(b) by 351 days.

(21) Appl. No.: 10/524,874

(22) PCT Filed: Dec. 2, 2004

(86) PCT No.: PCT/CA2004/002066

§ 371 (c)(1),
(2), (4) Date: Feb. 17, 2005

(87) PCT Pub. No.: WO2005/054622

PCT Pub. Date: Jun. 16, 2005

(65) Prior Publication Data

US 2006/0207768 A1 Sep. 21, 2006

(51) Int. Cl.
*E21B 25/00* (2006.01)
*F16L 25/00* (2006.01)

(52) U.S. Cl. ..... 166/85.5; 166/77.51; 166/378; 285/27

(58) Field of Classification Search ..... 166/380, 166/77.51, 85.5, 242.1, 242.6; 285/27
See application file for complete search history.

(56) References Cited

U.S. PATENT DOCUMENTS

| | | | | |
|---|---|---|---|---|
| 1,258,273 | A | 3/1918 | Titus et al. | |
| 3,445,144 | A | 5/1969 | McBrien | |
| 3,475,038 | A | 10/1969 | Matherne | |
| 3,576,062 | A | 4/1971 | Matherne | |
| 4,072,369 | A * | 2/1978 | Segreto | 175/325.7 |
| 4,213,237 | A | 7/1980 | Whiting | |
| 4,349,048 | A | 9/1982 | Clark et al. | |
| 4,599,778 | A | 7/1986 | Dreyfuss et al. | |
| 4,654,950 | A | 4/1987 | Maidlow | |
| 4,697,830 | A * | 10/1987 | Wood et al. | 285/27 |

* cited by examiner

*Primary Examiner*—David Bagnell
*Assistant Examiner*—Brad Harcourt
(74) *Attorney, Agent, or Firm*—Bennett Jones LLP

(57) ABSTRACT

A tubular stabbing protector includes: a plurality of body sections together forming a first opening and a second opening, the first opening sized to be secured over a pin end of an oilfield tubular and the second opening sized to fit over a connection to which the pin end of the tubular is to be engaged and opening away from the first opening; and a releasable lock between each adjacent body section of the plurality of body sections, the releasable lock being automatically releasable when the second opening is fit over the connection to permit the plurality of body sections to separate sufficiently to release the pin end.

39 Claims, 7 Drawing Sheets

TUBULAR STABBING PROTECTOR AND METHOD

FIELD OF THE INVENTION

The present invention is directed to a tubular stabbing protector and method and, in particular, a tubular stabbing protector for protecting an end of a tubular and guiding the tubular into engagement with a tubular connection and a method for using the tubular stabbing protector.

BACKGROUND

During the drilling of a borehole and the lining of the borehole once drilled, tubulars, such as drill tubular and casing, must be connected into a tubular string. The tubular string is extended into a borehole by connection of joints of tubular at a drilling rig.

For example, when running or drilling with casing a top drive can be used in a drilling rig for handling the casing string. In some well operations, an engaging apparatus, including an internal or external casing gripping mechanism, can be connected below the top drive to grip a joint of casing so that the engaging apparatus and casing can be driven axially and/or rotationally by the top drive.

In a drilling rig, the top drive can be hung in the mast with the engaging apparatus connected in drive communication and in substantial axial alignment therebelow. The top drive and engaging apparatus are hung in the mast above the well center, the top drive and engaging apparatus define a main axis of the drilling rig that is aligned with well center. Joints of casing, for connection into the drill or liner string, can be supported, for example in a V-door, adjacent the main axis of the drilling rig. For connection into the drill or liner string, the casing can be engaged by an elevator and brought under the drive system for engagement and handling. Generally, the elevator is supported on link arms suspended from the top drive or the engaging apparatus or cables extending from the top drive link arms.

To pick up a casing joint, the top drive is lowered to permit the elevator, either on conventional link arms or with the cables attached to the link arms, to be moved over and engaged about a casing joint on the V-door. The top drive is then hoisted to pull the casing off the V-door. Once free of the V-door, the tubular joint can be swung by gravity under the engaging apparatus. Then the top drive is lowered so that the tubular joint can be supported in a stump of the casing string, which is supported in the rotary table. Then the gripping mechanism can engage the tubular joint and drive the casing joint into the threaded connection exposed on the stump.

In this handling, the casing thread can be damaged and the tubular dope can be lost. In addition, it is sometimes difficult to align the free end of the casing joint with the stump.

SUMMARY OF THE INVENTION

A tubular stabbing protector has been invented.

In accordance with one aspect of the present invention, there is provided a tubular stabbing protector comprising: a plurality of body sections together forming a first opening and a second opening, the first opening sized to be secured over a pin end of an oilfield tubular and the second opening sized to fit over a connection to which the pin end of the oilfield tubular is to be engaged and opening away from the first opening; and a releasable lock between at least two adjacent body sections of the plurality of body sections, the releasable lock being automatically releasable when the second opening is fit over the connection to permit the plurality of body sections to separate sufficiently to release the pin end.

In accordance with another aspect of the present invention, there is provided a tubular stabbing protector comprising: a plurality of body sections connectable into an assembled form, the plurality of body sections in the assembled form together forming a first opening and a second opening away from the first opening, the first opening sized to be secured over a pin end of an oilfield tubular and the second opening sized to fit over a connection to which the pin end of the oilfield tubular is to be engaged, and a lock for releasably holding the plurality of body sections together in assembled form and releasable to permit expansion of the plurality of body sections out of their assembled form, the lock being automatically releasable by application of force radially outwardly applied to the surface of the second opening, permitting the plurality of body sections to expand.

In accordance with another broad aspect of the present invention, there is provided a method for connecting a tubular joint to a connector to form an oilfield tubular string, connecting a tubular stabbing protector over a pin end of the tubular joint, the tubular stabbing protector including a plurality of body sections connectable into an assembled form, the plurality of body sections in the assembled form together forming a first opening and a second opening axially aligned and opening away from the first opening, the first opening sized to be secured over a pin end of an oilfield tubular and the second opening sized to fit over a connection to which the pin end of the oilfield tubular is to be engaged, and a lock for releasably holding the plurality of body sections together in assembled form and releasable to permit expansion of the plurality of body sections out of their assembled form, the lock being automatically releasable when the second end is fit over the connection to permit the plurality of body sections to expand; moving the pin end toward the connection; fitting the second end over the connection; and stabbing the pin end toward the connection to automatically release the lock such that the plurality of body sections can expand out of engagement with the pin end.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings.

DETAILED DESCRIPTION OF THE DRAWINGS

Figure 1:
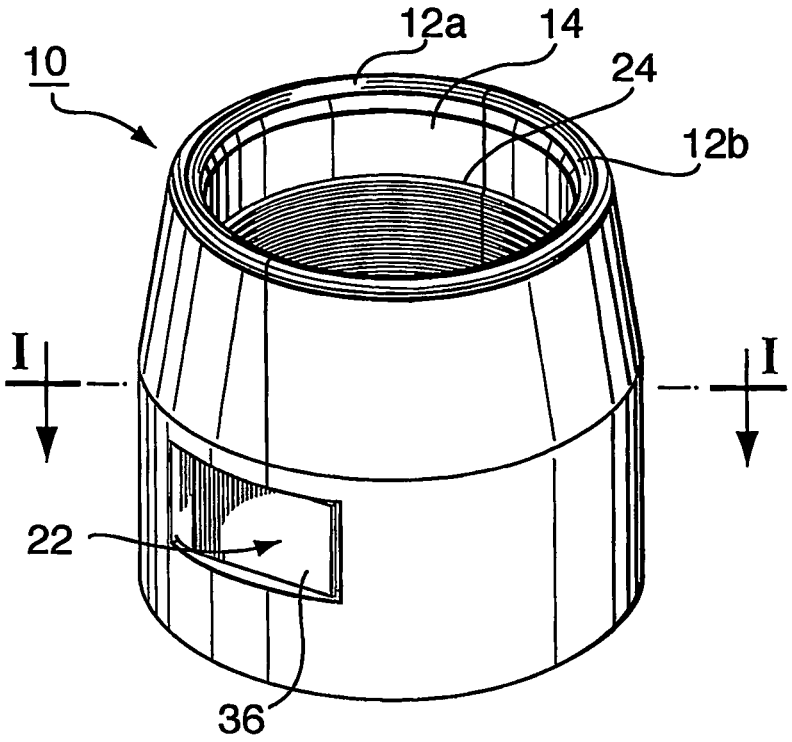
FIG. 1 is a top perspective view of a first embodiment of a tubular stabbing protector with the body sections latched together.
Figure 2:
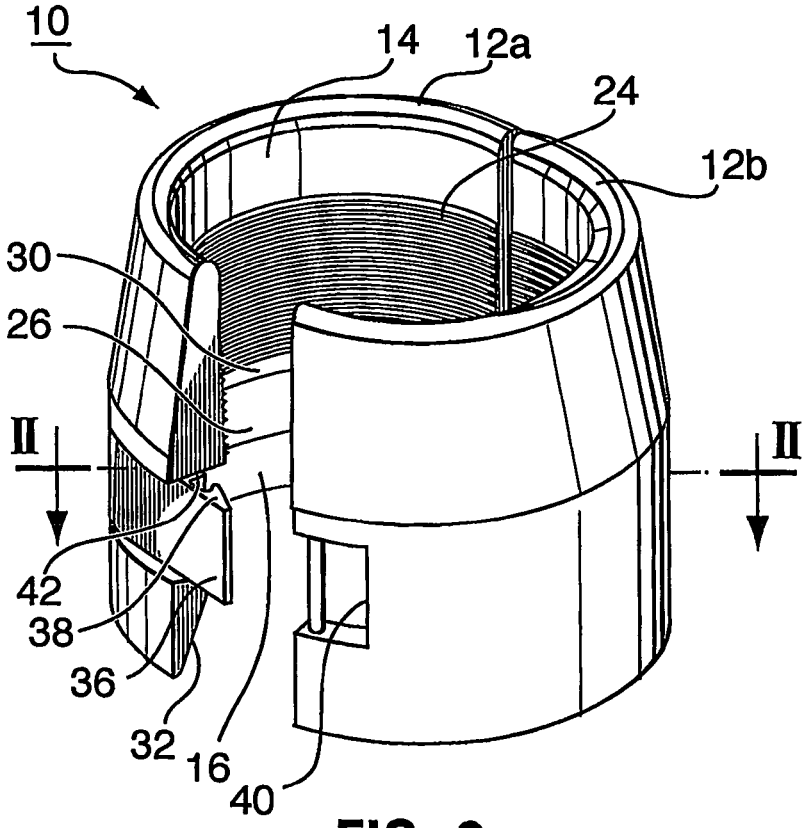
FIG. 2 is a top perspective view of the tubular stabbing protector of FIG. 1, unlatched and partially expanded.

Referring to FIGS. 1 to 5, a tubular stabbing protector 10 can include a plurality of body sections, which in this illustrated embodiment, is a first body section 12*a* and a second body section 12*b*. The body sections together in their assembled form forming a first opening 14 and a second opening 16. The second opening can be substantially axially aligned with, and opening away from, the first opening. First opening 14 can be sized to be secured over a pin end 18 of an oilfield tubular and second opening 16 can be sized to fit over a connection 20 to which pin end 18 of the oilfield tubular is to be engaged. A releasable lock 22 can be provided to releasably hold plurality of body sections 12*a*, 12*b* together (FIG. 1). Releasable lock 22 can be automatically releasable when second opening 16 is fit over connection 20 to permit the plurality of body sections to separate sufficiently FIG. 2) to release the pin end from first opening 14.

While two body sections 12*a*, 12*b* are shown it is to be understood that other numbers of body sections can be used. While the body sections 12*a*, 12*b*, as illustrated, are substantially identical in form, it is to be understood that the body sections need not be similar in form, provided they can form openings fittable over a pin end and a connector and provided that they can be released from the pin end and the connector, when the sections are separated from each other.

The body sections can each be formed as an elongate section of a cylinder, such that when they come together, a cylindrical body is formed defining the first opening at one end and the second opening at the other end. As such, the openings open away from each other and can be formed to align axially.

First opening 14 can be sized to fit over pin end 18 of a tubular with which the tubular stabbing protector is to be used. In the illustrated embodiment, first opening 14 can be sized to fit closely over a pin end 18 such that it becomes engaged on the pin end, once it is urged thereover. As such, opening 14 can cover and protect the threads of the pin end and hold any applied lubricant on the pin end, while the tubular is being transferred to the rig floor. Serrations 24 can be formed on the inner surface of the first female end to enhance engagement of the tubular stabbing protector over the threads of the pin end. Opening 14 can include a section 25 for bracing the stabbing protector on the pin end. Section 25 fits relatively securely about the pin OD on which it is to be used. The surface of section 25 can be concentric with the center axis of the protector and the tubular. This section can stabilize the fit of the stabbing protector on the pin end. Section 25 can also control the amount of prying force required to overcome the engagement at releasable lock 22. In particular, section 25 can generate an internal moment that tends to separate the body sections when separating force is applied at second opening 16. As the length of section 25 increases, the prying force required to overcome engagement at lock 22 is reduced.

Second opening 16 can be sized to fit over the connection to which pin end 18 of the oilfield tubular is to be engaged. In the illustrated embodiment, the connection is a coupling including a box threaded end for engaging the pin end of the tubular. While an upset end has been shown, it is to be understood that the stabbing protector can be used with other types of connections such as for example, a flush joint, wherein the OD at the connection is similar to the OD of the tubular on the pin end. Since, second opening 16 can be axially aligned with first opening 14, the tubular stabbing protector can act as a stabbing guide for bringing the pin end into alignment with its connection.

Second opening 16 can include an outer lip 28, a first inner wall 26 and a second inner wall 30. First inner wall 26 is adjacent outer lip 28 and includes an effective inner diameter ID1, which at its minimum is greater than the outer diameter OD of the connection at its end. Second inner wall 30 has an inner diameter ID2 at some point that is less than OD. As such second opening 16 can fit over connection 20, but is butted by the connection, once the connection reaches ID2.

First inner wall 26 can include a tapering, for example frustoconical, surface 32 that gradually reduces in diameter with depth into the opening to bring the connection into axial alignment with the first opening, as it enters opening 16. The surface can extend out to accommodate significant misalignment between the pin end and connection, if desired. Second inner wall 30 can also be tapered (i.e. including a frustoconical surface) to transition from first inner wall 26 to ID2. The operation and usefulness of these features will be better understood by reference to a mode of operation discussed hereinbelow.

There being two body sections 12*a*, 12*b* in the illustrated embodiment, the body sections come together at two interfaces. At the first interface, the body sections can be held together by a hinge 34 and at the second interface, they can be releasably held together by lock 22. Lock 22 can include a latch 36 with a catch 38 and a trigger protrusion 42 on one of the body sections and a strike 40 on the other body section for receiving the catch 38. Latch 36 can be elastically deformable, such as made of thin alloy steel, and positioned to bias catch 38 inwardly so that it drops into strike 40, when the catch is aligned with the strike. Catch 38 can be formed to fit and engage in the strike and can be formed with a radiused or ramped locking surface 38*a*.

Trigger protrusion 42 can be positioned adjacent catch and can be sized to extend through an opening through one or both of sections 12*a*, 12*b* to protrude into the inner diameter of opening 16. In the illustrated embodiment, trigger protrusion 42 extends between the body sections of the tubular stabbing protector, but it is to be understood that other configurations can be employed, for example protrusion can be mounted directly on catch 38, provided it extends into opening 16 to be open for abutment against connection 20 when the connection is moved into the opening. Trigger protrusion 42 can be formed with a radiused or ramped contact edge 42*a*. The operation and usefulness of these features will be better understood by reference to a mode of operation discussed hereinbelow.

In use, oil field tubular stabbing protector 10 can be used to protect a tubular during handling and to facilitate connection of that tubular to a connection 20. First opening 14 can be fit over pin end 18 of the tubular, either (i) by opening sections 12*a*, 12*b* at hinge 34, positioning the guide with the end forming opening 14 aligned with pin end 18 and closing the sections about the pin end until catch 38 drops into strike 40 or (ii) by closing and locking, using lock 22, the sections 12*a*, 12*b* to form opening 14 and urging the opening over the pin end. Positioning of catch 38 into strike 40 can be facilitated by the radiusing in locking surface 38*a*. Lubricant can be applied between the stabbing protector and the pin end, which lubricant being, for example, intended to be included in connection between the pin and its connection. The lubricant can be held in the interstices between the pin threads and serrations 24.

After, tubular stabbing protector 10 is engaged on the pin end, it can be brought over the connection into which it is to be engaged. Second opening 16 can be brought down, arrow A in FIG. 5, over the connection, using surface 32 to guide the connection into the opening and into axial alignment with first opening 14. As the second opening is pushed down over the connection, an upper edge of the connection comes into contact with trigger protrusion 42 along its contact edge 42*a*. Since the contact edge can be radiused or ramped, any force of connection entering the opening can tend to drive the trigger protrusion, and thereby catch 38, out against the bias in latch 32 to permit movement therepast of the connection. Continued application of the tubular stabbing protector over the connection, drives second inner wall 30 against the connection. When the connection butts against ID2, any further force of the tubular stabbing protector down over the connection can tend to force sections 12*a*, 12*b* to expand outwardly and to pull catch 38 out of strike 40.

Once the catch is out of engagement with strike 40, the tubular stabbing protector can pop off the pin end and the connection, and can drop to the rig floor. In one embodiment, the end of the pin can be inside the coupling for example about 0.5 inches, when the tubular stabbing protector pops off. This can avoid the pin from coming out of alignment before it is within the coupling. The tubular stabbing protector, once off the pin end, can then be collected and returned for connection about a subsequent tubular.

Figure 8:
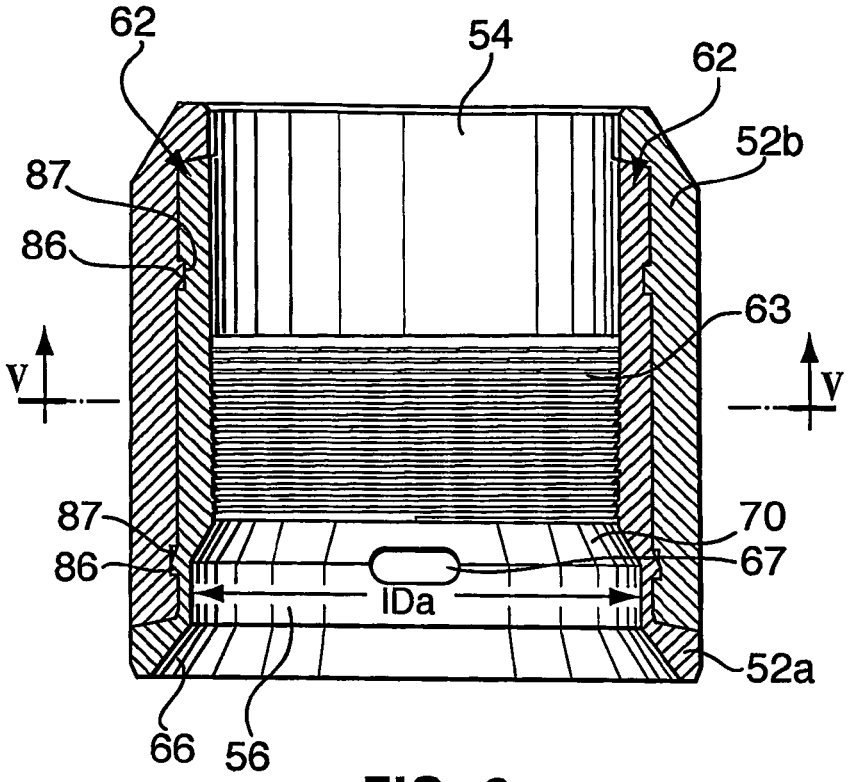
FIG. 8 is an axial sectional view of the oilfield tubular stabbing protector of FIG. 6 in assembled form. The axial section corresponds to line IV-IV of FIG. 9.
Figure 9:
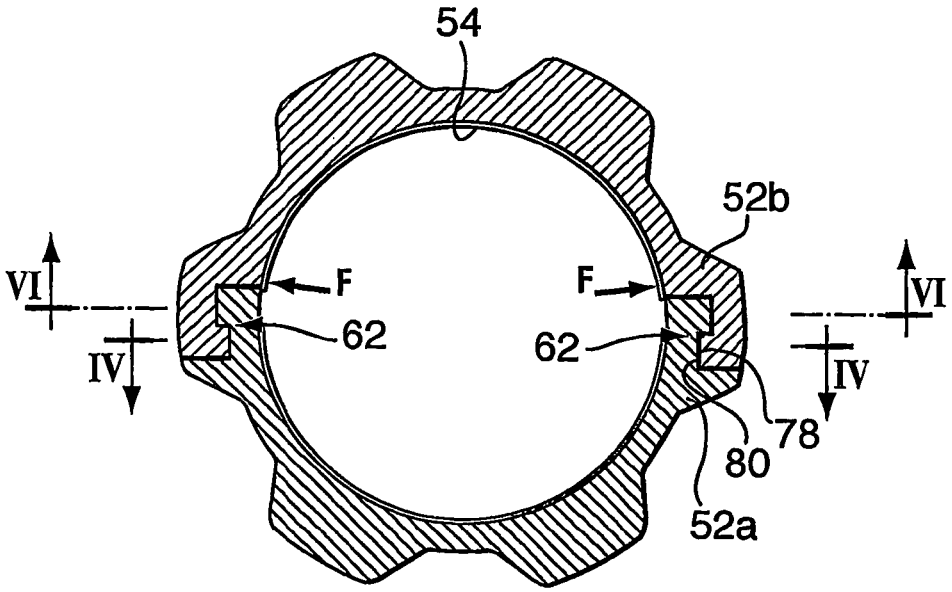
FIG. 9 is a sectional view taken along line V-V of FIG. 8.
Figure 10:
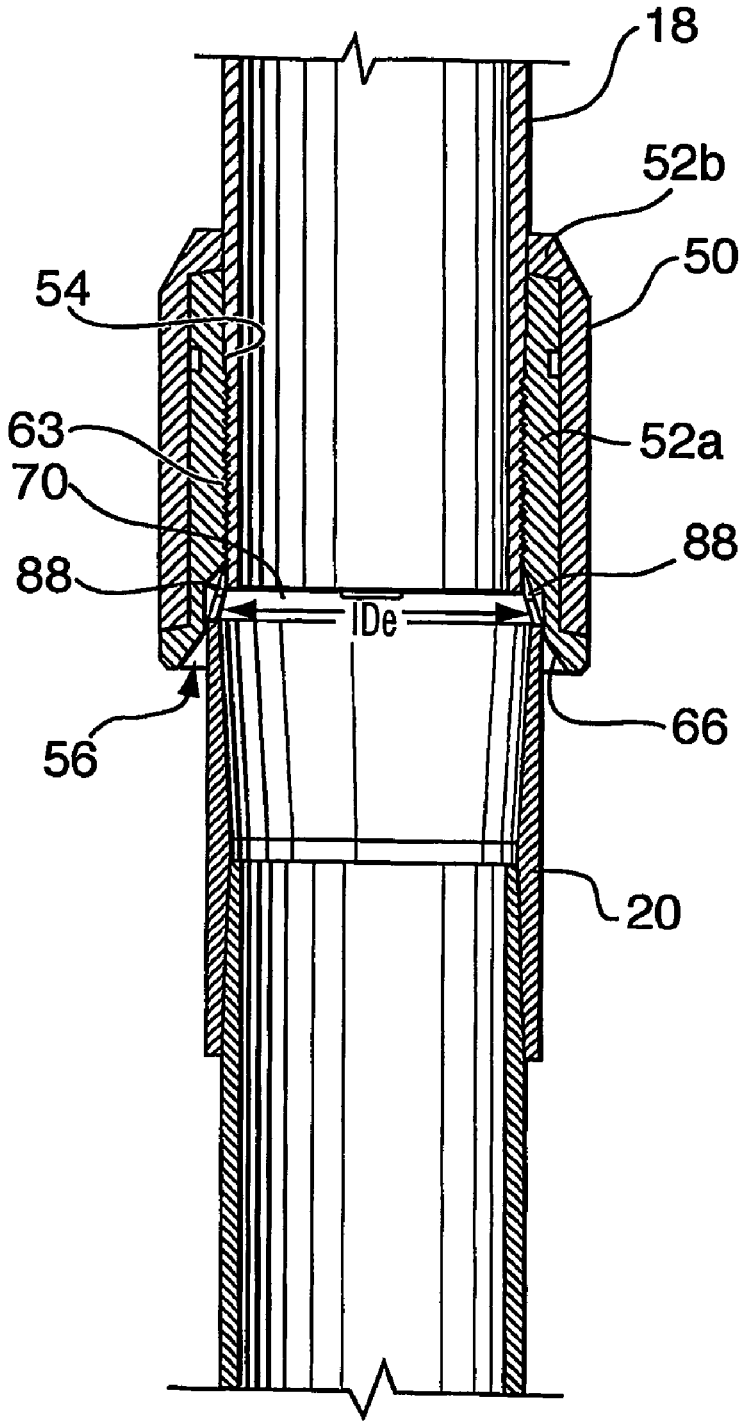
FIG. 10 is an axial sectional view through a tubular having a tubular stabbing protector of FIG. 6 secured thereto and aligned with a tubular connection. The axial section corresponds to line VI-VI of FIG. 9.
Figure 11:
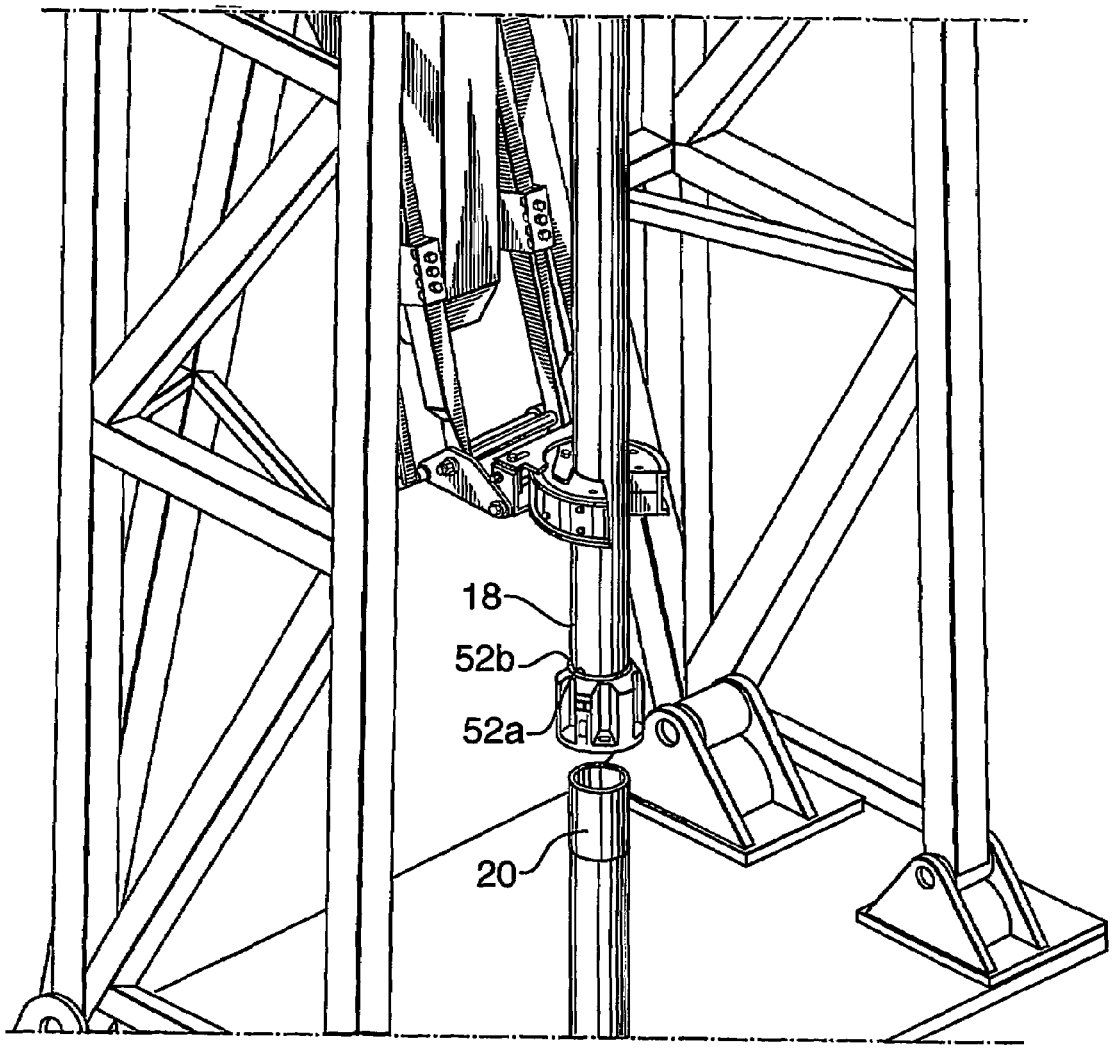
FIG. 11 is a perspective view of an oilfield tubular stabbing protector on a tubular being moved toward a tubular connector stump engaged in a drill rig floor.

Another oilfield tubular stabbing protector 50 is shown in FIGS. 6 to 11. The illustrated oilfield tubular stabbing protector includes body sections 52*a*, 52*b* connectable into an assembled form (FIGS. 8 and 9). Body sections 52*a*, 52*b* can be longitudinal sections of a cylinder and in the assembled form, can form a first opening 54 and a second opening 56 axially aligned with, and opening away from, the first opening. First opening 54 can be sized to be secured over a pin end 18 of an oilfield tubular and second opening 56 can be sized to fit over a connection 20 to which the pin end of the oilfield tubular is to be engaged. Body sections define locks 62 for releasably holding the body sections together in the assembled form. Locks 62 can be automatically releasable to permit expansion of the body sections out of their assembled form, when the second end is fit over the connection.

First opening 54 can be sized to fit over pin end 18 of a tubular with which the tubular stabbing protector is to be used. In the illustrated embodiment, first opening 54 can be sized to fit closely over a pin end 18 such that it becomes engaged on the pin end, once it is urged thereover. As such, opening 54 can cover and protect the threads of the pin end and hold any applied lubricant on the pin end, while the tubular is being transferred to the rig floor. Serrations 63 can be formed on the inner surface of the first female end. The serrations can be formed to match the thread pitch on the pin end to permit threaded engagement of the tubular stabbing protector to the threads of the pin end.

Second opening 56 can be sized to fit over the connection to which pin end 18 of the oilfield tubular is to be engaged. In the illustrated embodiment, the connection is a coupling including a box end for engaging the pin end of the tubular. Second opening 56 can be axially aligned with first opening 54 so that the tubular stabbing protector can act as a stabbing guide for bringing the pin end into alignment with its connection.

Second opening 56 can include an inner wall 66 adjacent its open end, which at its minimum has an inner diameter IDa greater than the end outer diameter OD of the connection. Second opening 56 can also include a second area 70, inwardly disposed from inner wall 66, which has an effective inner diameter IDe at some point that is less than OD. As such second opening 56 can fit over connection 20, but is butted by the connection, once the connection reaches IDe of the second area.

First inner wall 66 can be frustoconically formed to have a diameter that reduces with increased depth into the opening.

The tubular stabbing protector can include a window 67 opening from an outer side of a body section to opening 54 or opening 56. Window 67, in the illustrated embodiment, can be at the transition of opening 54 to area 70, such that the end of the pin is visible when the stabbing protector is properly installed.

Body sections 52*a*, 52*b* can be fully separated but are connected together in the assembled configuration by locks 62 at their interfaces. The locks are formed by an interlocking arrangement, wherein one body section 52*a* includes grooves 78 along its side edges and the other body section 52*b* includes overlapping catches 80 on its side edges that are positioned to drop into and catch in grooves 78. While the grooves and catches can be formed to interengage, these parts can be formed such that catches 80 can lift out of the grooves 78 if radially outwardly directed force is applied against section 52*b* adjacent catches 80. In the illustrated embodiment, grooves 78 and catches 80 extend substantially along the entirety of the side edges. However, it will be appreciated that a plurality of groove/catch arrangements can be spaced apart along the interfacing side edges.

The formation of grooves 78 and catches 80 along the length of the side edges permits the body sections to be connected by axially aligning the catches with the grooves and sliding the body sections together. Stop walls 82 can be provided at the ends of the grooves and stop walls 84 can be positioned at the end of the catches to limit installation of the catches in the grooves. Protrusions 86 and corresponding indents 87 can be positioned along the grooves/catches to releasably lock the body sections together axially so that they do not slide out of engagement. Channels 89 are provided to permits protrusions to move radially out of indents 87 so that radial movement of the sections apart is not stopped by the protrusions. Of course, the tubular stabbing protector is operable without the stop walls and protrustions.

Pressure ramps 88 are positioned in opening 56 on body section 52*b* adjacent catches 80. Pressure ramps 88 define IDe of the second area.

In use, oil field tubular stabbing protector 50 can be used to protect a tubular during handling and to facilitate connection of that tubular to a connection 20 to form an oilfield tubular string. To do so, sections 52*a*, 52*b* can be locked together to define first opening 54 and second opening 56. The body sections can be assembled by aligning catches 80 with grooves 78 and axially sliding the body sections together until stop walls 82 and 84 limit installation of the catches in the grooves. Protrusions 86 can then drop into their corresponding indents 87 to lock the body sections in axial position relative to each other with catches 80 engaged in grooves 78. First opening 54 can be then be fit over pin end 18 of the tubular by use of threads 63. The advancement of pin 18 into first opening 54 can be observed through window 67 and, in particular, the tubular stabbing protector can be pushed or threaded over the pin end until the end face of pin end 18 is visible through window 67, when the window is positioned at area 70.

After, tubular stabbing protector 50 is engaged on pin end 18, the pin end can be brought over the connection into which it is to be engaged. The conical form of surface 66, acts as a funnel to bring the tubular stabbing protector, and thereby the tubular, into axial alignment with the connection, as the guide is moved down over the connection. As second opening 56 is pushed down over the connection, an upper edge of the connection comes into contact with pressure ramps 88. Stabbing the pin end into the connection, applies radially outwardly directed force, arrows F of FIG. 9, through ramps 88 to drive catches 80 out of engagement with grooves 78. After the connection butts against IDe, any further force of the tubular stabbing protector down over the connection can tend to force sections 52*a*, 52*b* to expand outwardly and drop away from the pin end and the connection. At this point, the pin end of the tubular can already be inside the connector a distance such as, for example about 0.5 inches.

The apparatus can be constructed in various ways with various materials, as would be appreciated by a skilled workman. Durable materials can be used to permit reuse. Some suitable materials include polymers, such as, for example, urethane, metals, such as, for example, alloy steel, or combinations thereof. Materials can be selected to reduce drag resistance during tubular handling.

Figure 3:
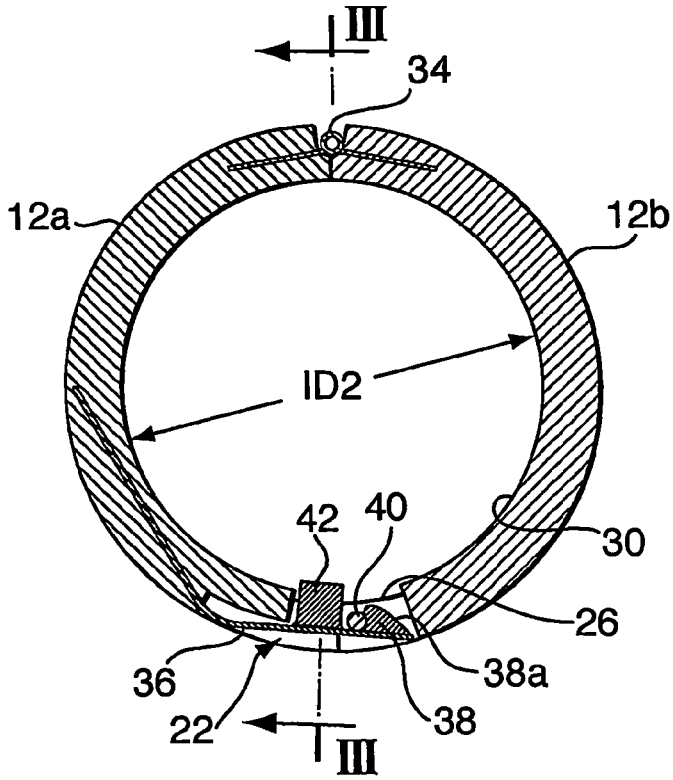
FIG. 3 is a section along line I-I of FIG. 1.
Figure 4:
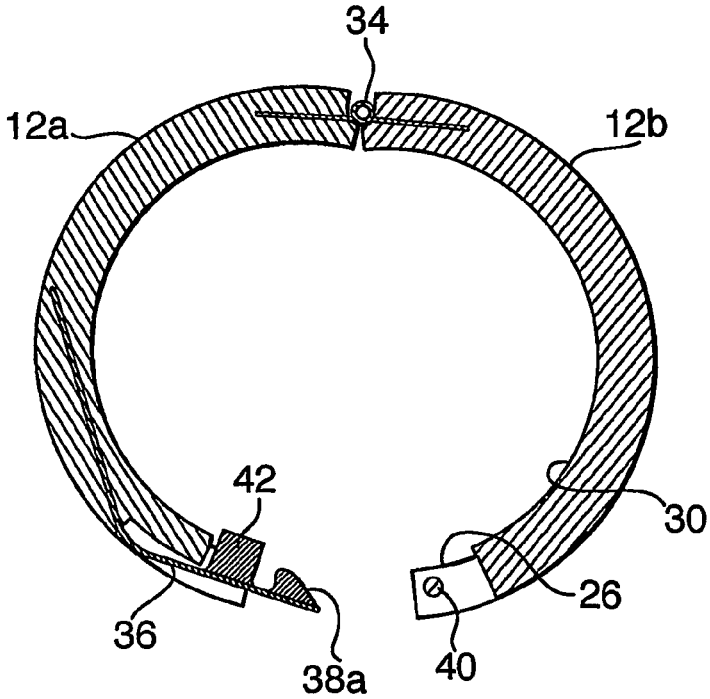
FIG. 4 is a section along line II-II of FIG. 2.
Figure 5:
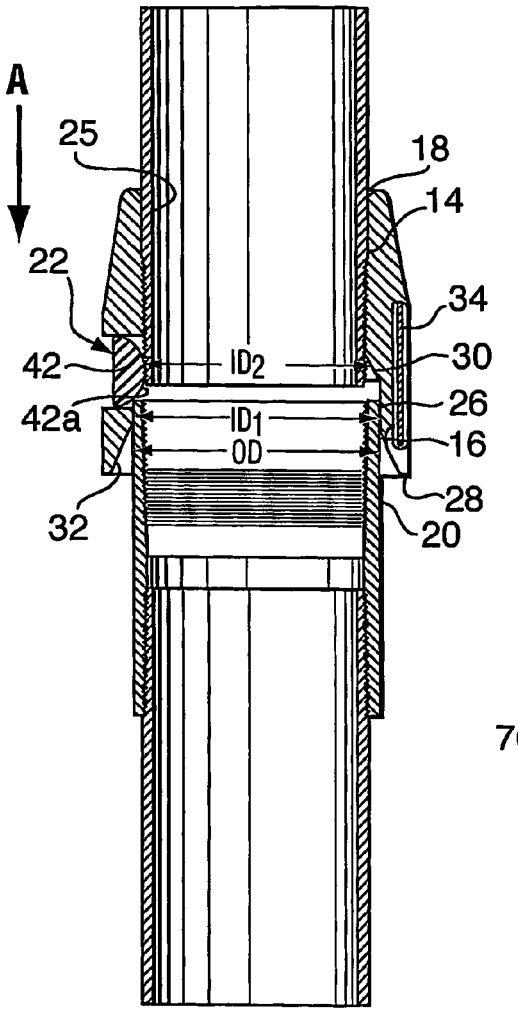
FIG. 5 is an axial sectional view through a tubular having a tubular stabbing protector secured thereto and aligned with a tubular connection. The axial section corresponds to line III-III of FIG. 3.
Figure 6:
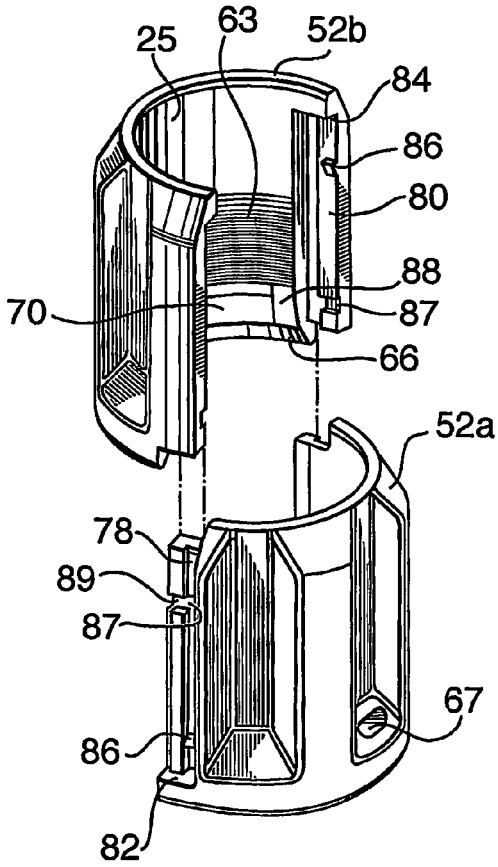
FIG. 6 is a perspective view of another oilfield tubular stabbing protector with the body sections aligned for interconnection.
Figure 7A:
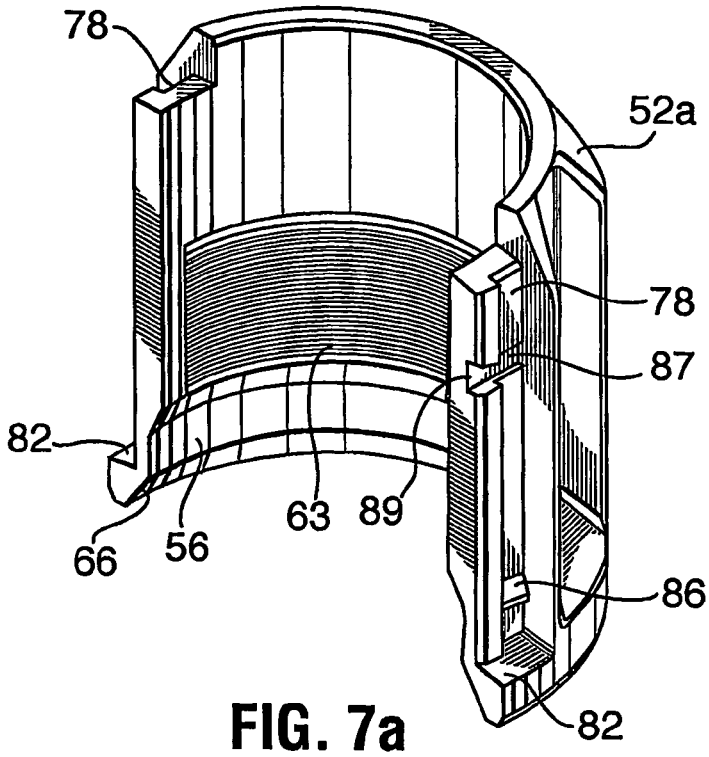
FIGS. 7*a* and 7*b* are perspective views of the body sections of FIG. 6.
Figure 7B:
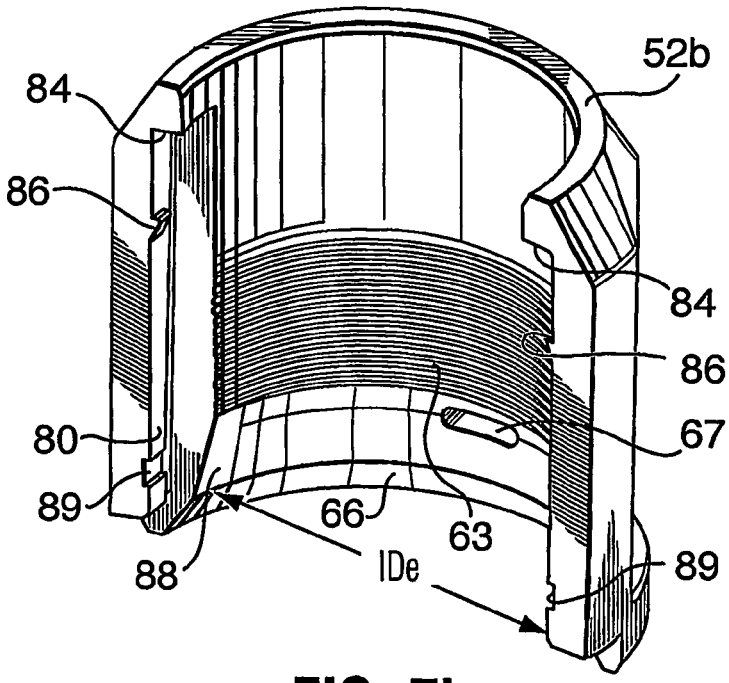

FIGS. 3 and 4 show one possible method of manufacture of the tubular stabbing protector wherein latch 36 and hinge 34 are imbedded at their ends into the material of the body sections, as by molding about the material about the mounted ends of the latch and the hinge. Of course, other methods of manufacture can be used.

It will be apparent that many other changes may be made to the illustrative embodiments, while falling within the scope of the invention and it is intended that all such changes be covered by the claims appended hereto.

What is claimed is:

1. A tubular stabbing protector comprising: a plurality of body sections together forming a first opening and a second opening, the first opening sized to be secured over a pin end of an oilfield tubular and the second opening sized to fit over a connection to which the pin end of the oilfield tubular is to be engaged and opening away from the first opening; and a releasable lock between at least two adjacent body sections of the plurality of body sections, the releasable lock being automatically releasable when the second opening is fit over the connection to permit the plurality of body sections to separate sufficiently to release the pin end.

2. The tubular stabbing protector of claim 1 wherein the plurality of body sections are fully separable.

3. The tubular stabbing protector of claim 1 wherein the plurality of body sections are connected by a hinge and expandable by pivoting about the hinge.

4. The tubular stabbing protector of claim 1 wherein the first opening and the second opening are axially aligned.

5. The tubular stabbing protector of claim 1 wherein the first opening and the second opening are open to each other.

6. The tubular stabbing protector of claim 1 wherein the second opening includes an inner diameter change and includes a section with an effective inner diameter greater than the end face outer diameter of the connection and another section with an effective inner diameter less than the end face outer diameter of the connection.

7. The tubular stabbing protector of claim 1 wherein the second opening includes a frustoconically formed inner wall with an inner diameter reducing with depth into the opening.

8. The tubular stabbing protector of claim 1 wherein the first opening includes serrations.

9. The tubular stabbing protector of claim 8 wherein the serrations are formed as threads.

10. The tubular stabbing protector of claim 1 further comprising a trigger protrusion biased into the second opening and disposed to be forced radially outwardly to drive the plurality of body sections to expand, by placement of the second opening over the connection.

11. The tubular stabbing protector of claim 1 further comprising a pressure ramp in the second opening and disposed to be forced radially outwardly to drive the plurality of body sections to expand, by placement of the second opening over the connection.

12. The tubular stabbing protector of claim 1 wherein the lock includes a catch on one body section for engaging in a strike on an adjacent body section when the body sections are in the assembled position, the catch being actuable to come out of engagement with the strike by placement of the second opening over the connection.

13. The tubular stabbing protector of claim 1 wherein the lock includes a catch on one body section for engaging in a groove on an adjacent body section when the body sections are in the assembled position, the catch being actuable to come out of engagement with the groove by placement of the second opening over the connection.

14. The tubular stabbing protector of claim 1 wherein the tubular stabbing protector is formed of a material including a polymer.

15. The tubular stabbing protector of claim 1 wherein the tubular stabbing protector is molded from a polymer.

16. The tubular stabbing protector of claim 1 further comprising an observation window through a body section.

17. The tubular stabbing protector of claim 1 wherein the lock includes a catch on one body section for engaging in a groove on an adjacent body section when the body sections are in the assembled form and a pressure ramp formed on the body section adjacent the catch, the pressure ramp extending into the second opening and disposed to be forced radially outwardly to drive the catch out of engagement with the groove, by placement of the second opening over the connection.

18. A tubular stabbing protector comprising: a plurality of body sections connectable into an assembled form, the plurality of body sections in the assembled form together forming a first opening and a second opening away from the first opening, the first opening sized to be secured over a pin end of an oilfield tubular and the second opening sized to fit over a connection to which the pin end of the oilfield tubular is to be engaged, and a lock for releasably holding the plurality of body sections together in assembled form and releasable to permit expansion of the plurality of body sections out of their assembled form, the lock being automatically releasable by application of force radially outwardly applied to the surface of the second opening, permitting the plurality of body sections to expand.

19. The tubular stabbing protector of claim 18 wherein the plurality of body sections are fully separable.

20. The tubular stabbing protector of claim 18 wherein the plurality of body sections are connected by a hinge and expandable by pivoting about the hinge.

21. The tubular stabbing protector of claim 18 wherein the first opening and the second opening are axially aligned.

22. The tubular stabbing protector of claim 18 wherein the first opening and the second opening are open to each other.

23. The tubular stabbing protector of claim 18 wherein the second opening includes an inner diameter change and includes a section with an effective inner diameter greater than the end face outer diameter of the connection and another section with an effective inner diameter less than the end face outer diameter of the connection.

24. The tubular stabbing protector of claim 18 wherein the second opening includes a frustoconically formed inner wall with an inner diameter reducing with depth into the opening.

25. The tubular stabbing protector of claim 18 wherein the first opening includes serrations.

26. The tubular stabbing protector of claim 25 wherein the serrations are formed as threads.

27. The tubular stabbing protector of claim 18 further comprising a trigger protrusion biased into the second opening and disposed to be forced radially outwardly to drive the plurality of body sections to expand, by placement of the second opening over the connection.

28. The tubular stabbing protector of claim 18 further comprising a pressure ramp in the second opening and disposed to be forced radially outwardly to drive the plurality of body sections to expand, by placement of the second opening over the connection.

29. The tubular stabbing protector of claim 18 wherein the lock includes a catch on one body section for engaging in a strike on an adjacent body section when the body sections are in the assembled position, the catch being actuable to come out of engagement with the strike by placement of the second opening over the connection.

30. The tubular stabbing protector of claim 18 wherein the lock includes a catch on one body section for engaging in a groove on an adjacent body section when the body sections are in the assembled position, the catch being actuable to come out of engagement with the groove by placement of the second opening over the connection.

31. The tubular stabbing protector of claim 18 wherein the tubular stabbing protector is formed of a material including a polymer.

32. The tubular stabbing protector of claim 18 wherein the tubular stabbing protector is molded from a polymer.

33. The tubular stabbing protector of claim 18 further comprising an observation window through a body section.

34. The tubular stabbing protector of claim 18 wherein the lock includes a catch on one body section for engaging in a groove on an adjacent body section when the body sections are in the assembled form and a pressure ramp formed on the body section adjacent the catch, the pressure ramp extending into the second opening and disposed to be forced radially outwardly to drive the catch out of engagement with the groove, by placement of the second opening over the connection.

35. A method for connecting a tubular joint to a connector to form an oilfield tubular string, connecting a tubular stabbing protector over a pin end of the tubular joint, the tubular stabbing protector including a plurality of body sections connectable into an assembled form, the plurality of body sections in the assembled form together forming a first opening and a second opening axially aligned and opening away from the first opening, the first opening sized to be secured over a pin end of an oilfield tubular and the second opening sized to fit over a connection to which the pin end of the oilfield tubular is to be engaged, and a lock for releasably holding the plurality of body sections together in assembled form, the lock being releasable to permit expansion of the plurality of body sections out of their assembled form and being automatically releasable when the second end is fit over the connection to permit the plurality of body sections to expand; moving the pin end toward the connection; fitting the second end over the connection; and stabbing the pin end toward the connection to automatically release the lock such that the plurality of body sections can expand out of engagement with the pin end.

36. The method of claim 35 wherein the tubular stabbing protector includes a trigger protrusion biased into the second opening and disposed to be forced radially outwardly by the connection to automatically release the lock.

37. The method of claim 35 wherein the tubular stabbing protector includes a pressure ramp in the second opening and disposed to be forced radially outwardly by the connection to automatically release the lock.

38. The method of claim 35 further comprising allowing the expanded tubular stabbing protector to fall to the drill floor once the plurality of body sections have expanded out of engagement with the pin end.

39. The method of claim 35 further comprising collecting the expanded tubular stabbing protector and connecting the tubular stabbing protector to another pin end.

* * * * *